US005231814A

United States Patent [19]

Hageman

[11] Patent Number: 5,231,814

[45] Date of Patent: Aug. 3, 1993

[54] ROOF DECKING WITH REDUCED RADIATION

[76] Inventor: Robert Hageman, 6700 Side Saddle, Austin, Tex. 78745

[21] Appl. No.: 780,956

[22] Filed: Oct. 23, 1991

Related U.S. Application Data

[63] Continuation-in-part of Ser. No. 493,411, Mar. 14, 1990, abandoned.

[51] Int. Cl.[5] ..... E04D 3/35

[52] U.S. Cl. ..... 52/408; 52/409; 52/411

[58] Field of Search ..... 52/408, 409, 411; 428/137

[56] References Cited

U.S. PATENT DOCUMENTS 1,914,345 6/1933 Roos ..... 52/408

1,974,465 9/1939 Lewis .

3,041,219 6/1962 Steck ..... 428/138

*Primary Examiner*—Richard E. Chilcot, Jr.

*Assistant Examiner*—Matthew E. Leno

*Attorney, Agent, or Firm*—Walter C. Farley

[57] ABSTRACT

A decking or sheathing material for roofing includes a sheet of plywood or OSB with a reflective layer of foil material adhered thereto, the foil material including a layer of metallic foil such as aluminum and a kraft paper backing. The roof decking is fastened to rafters in a typical roof structure with the foil facing downwardly and exposed to air. A machine for applying the foil material to sheets of plywood includes a conveyer belt table for conveying the plywood sheets in succession, an adhesive roller for uniformly applying a layer of adhesive to the upwardly facing surfaces of the plywood sheets and a roller for pressing the foil material onto the adhesive-coated surfaces of the plywood from a supply roll.

2 Claims, 4 Drawing Sheets

ROOF DECKING WITH REDUCED RADIATION

CROSS-REFERENCE TO RELATED APPLICATION

This application is a continuation-in-part of Ser. No. 07/493,411 filed Mar. 14, 1990 now abandoned.

FIELD OF THE INVENTION

This invention relates to a laminated foil and plywood material for use as roof decking and to a roof structure using the decking material.

BACKGROUND OF THE INVENTION

Roof decking generally comprises sheets of plywood, oriented strand board (OSB) or the like which are nailed or otherwise fastened to structural members i.e., rafters, defining the roof of a building. The decking forms the substrate onto which water-shedding materials, such as tar paper and shingles, are attached to complete the roof.

This structure provides rather little insulation, the insulative properties of the roof structure being limited to that of the materials themselves. Efforts to improve the insulative solar or heat emitting properties of the roof have been limited to insulative materials applied to the exterior side of the roof decking under the water-shedding materials, or insulative or reflective materials hung below the decking layer.

SUMMARY OF THE INVENTION

An object of the invention is to provide an improved material for use as roof decking which has a layer of perforated foil laminated onto one surface thereof to improve the resistance to downward summertime solar heat flow in common attic decking materials without causing problems of moisture accumulation.

A further object is to provide a roof structure in which the roof decking includes a layer of perforated foil on the inner or downwardly facing surface thereof to drastically reduce radiation of solar heat into the attic or other space immediately below the roof.

Briefly described, the invention includes a roof structure with a roof framing structure having rafters for supporting roofing material and a roof decking material attached thereto. The decking material includes a substantially flat sheet of substantially rigid construction material having an inwardly facing side and an outwardly facing side and a sheet of foil material having one surface adhered to the inwardly facing surface of the sheet of construction material. The foil and construction material composite is fastened to the rafters with the foil facing down toward the rafters so that the surface of the foil between said rafters is exposed to air. The foil material includes substantially uniformly distributed perforations through the foil material to permit passage of moisture therethrough.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification, and wherein.

DETAILED DESCRIPTION OF THE PREFERRED EMBODIMENT

Figure 1:
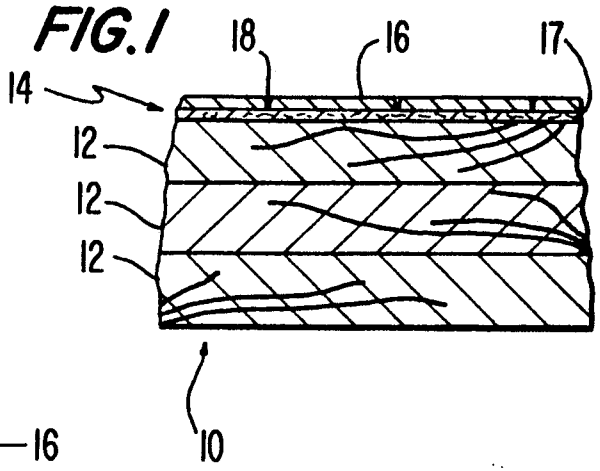
FIG. 1 is a partial side elevation, in section, of a roof decking material in accordance with the invention.

As previously indicated, it is well-known to attach sheets of plywood on top of roof rafters to form roof sheathing or decking which is, in turn, covered by roofing materials such as tar paper, shingles or the like. Roof decking in accordance with the present invention is illustrated in a partial sectional view in FIG. 1 and includes the conventional plywood indicated generally at 10 which can have a plurality of plies or separate layers of wood 12 which are laminated together, and a foil covering indicated generally at 14. The foil material used for the covering includes a layer 16 of metallic foil such as aluminum foil and a backing material 17 comprising a paper such as 20–40 lb. kraft paper. While a sheet of foil could be used without the kraft paper backing since the kraft paper has no significant insulative or reflective properties, the strength and ease of handling is better with the foil-kraft paper laminate and makes handling the material more convenient.

Of particular importance to the present invention is the provision of a plurality of perforations 18 through the layer of metallic foil. The provision of perforations 18 is particularly important because it eliminates problems associated with trapped moisture in structural materials made of wood, which moisture can lead to rapid degradation or decay of the materials. Perforations 18 permit the materials to "breathe". The foil material, with its kraft paper backing, is applied to only one major surface of the plywood which, in use, will be the inwardly facing surface, to allow free moisture to escape. This free moisture is largely due to accumulation of moisture in the plywood attributable to rain prior to the "drying in" stage of construction.

Provision of the metallic foil 16 on one side of the decking is effective to reflect heat back in tne direction from which it comes. Thus, in the summertime, the foil reflects heat back toward the sky and in the winter the foil reflects heat back in the direction of the house. Normally, the decking in accordance with the invention would be applied with the foil layer facing inwardly toward the attic of the house. The low emissive, highly reflective foil must face at least one adjacent air space (the attic) to block radiated heat transfer.

Unperforated material is manufactured for use as a wrapping material used to enclose bats of insulation such as fiberglass or the like which is then used to surround ductwork in air conditioning or the like. In that context, the unperforated material comprises a barrier to moisture, preventing the moisture from entering the enclosed insulation batting.

Figure 2:
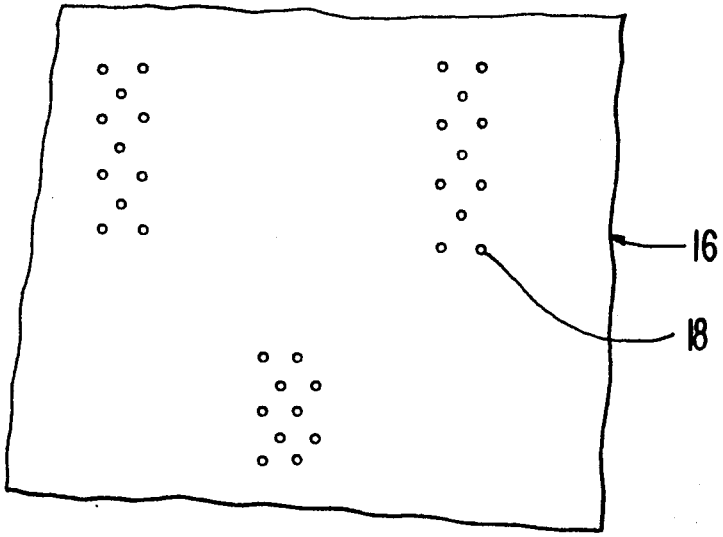
FIG. 2 is a plan view of a portion of foil material adhered to a sheet of plywood in accordance with the present invention.
Figure 3:
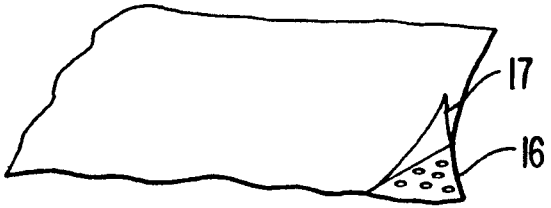
FIG. 3 is a partial perspective and partially separated view of the foil material of FIG. 2 showing the combination of a thin sheet of foil adhered to a backing of kraft paper.

A plan view of the structure of FIG. 1 is illustrated in FIG. 2, showing the perforations in approximately true scale. As shown in FIGS. 2 and 3, the perforations extend only through metallic foil 16 and not through the kraft paper 17 to which it is attached. The kraft paper is, in itself, capable of breathing and need not be perforated, although perforations through or partly through the paper are not particularly detrimental. The kraft paper is provided for physical support of the foil during the handling which precedes attachment of the foil material to the plywood. The density of perforations is in the order of 125 per square inch, although perforations in the range of from about 50 to about 160 per square inch are usable. Each perforation is about 0.06 mm or less in diameter.

The foil material, including the metallic foil layer 16 and kraft paper 17, is generally obtained in large rolls having a width of about 4 feet to conform to the normal width of the plywood sheath which are supplied 4 feet wide and 8 feet long. The rolls are supplied with the kraft paper surface of the foil material facing outwardly. Thus, the material can be applied to the plywood by spreading a coat of adhesive to the plywood, applying the material over the adhesive to the plywood and pressing the material onto the plywood. After the adhesive dries or cures, the decking is ready for use.

Figure 4:
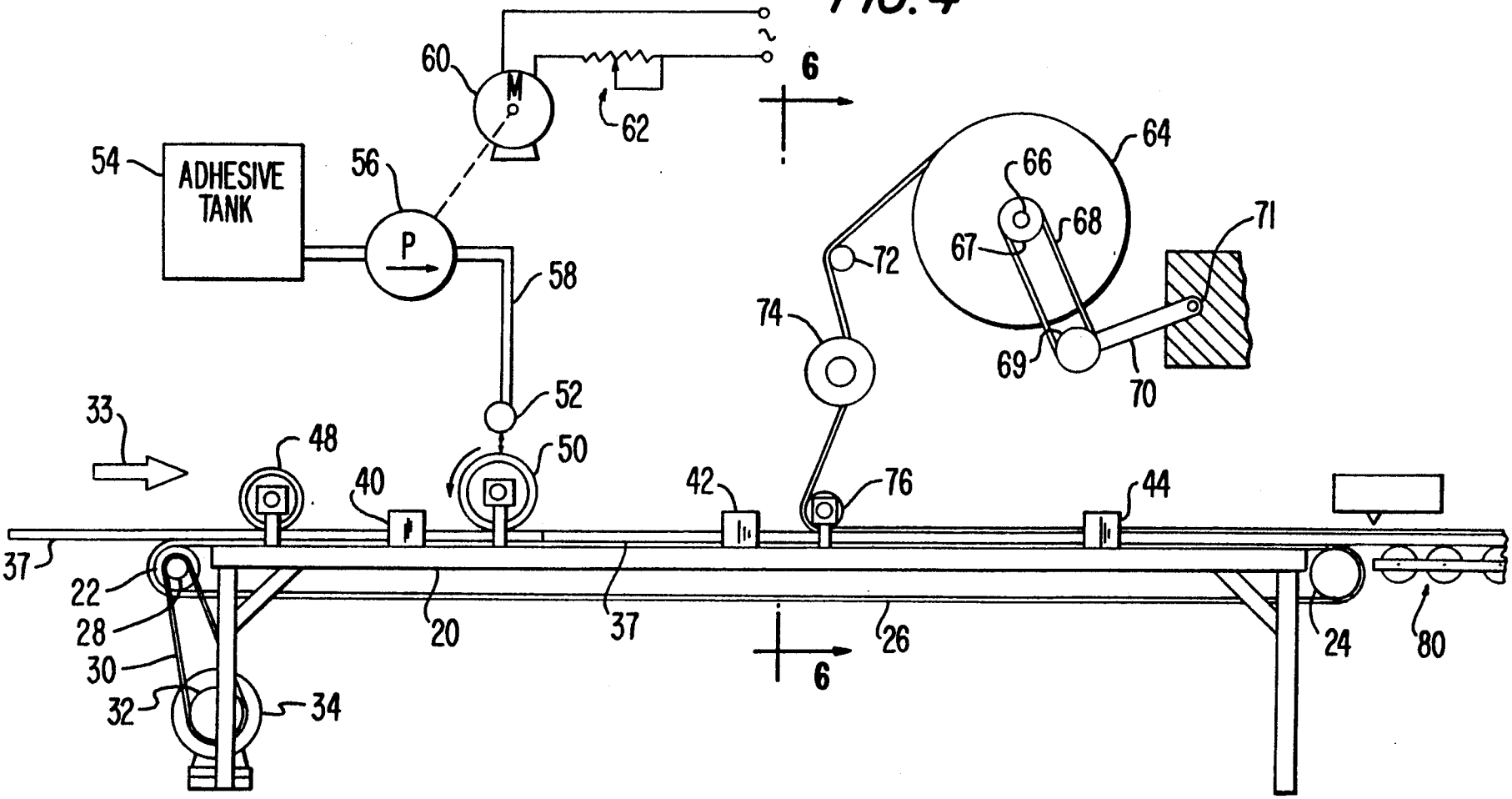
FIG. 4 is a schematic side elevation of an apparatus in accordance with the invention for adhering a layer of foil material to plywood to form the roof decking material of FIG. 1.
Figure 5:
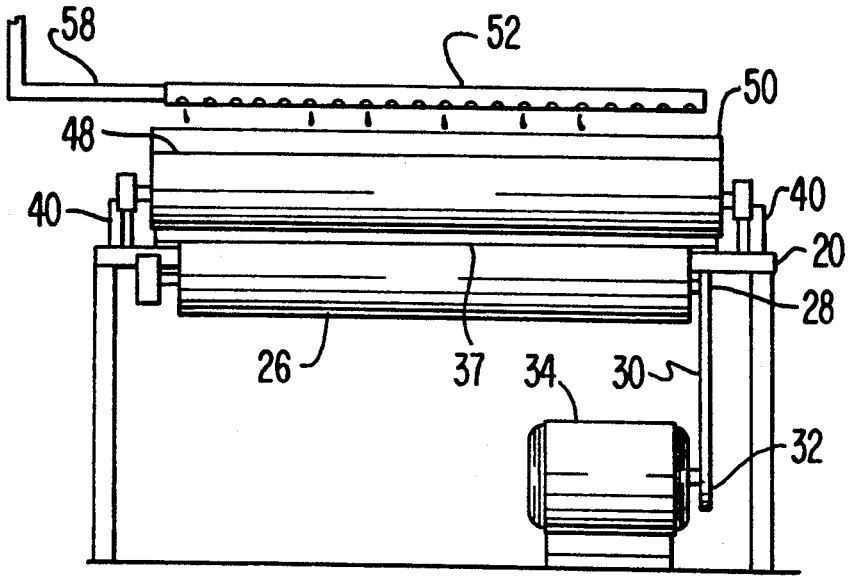
FIG. 5 is a schematic end elevation of the apparatus of FIG. 4.
Figure 6:
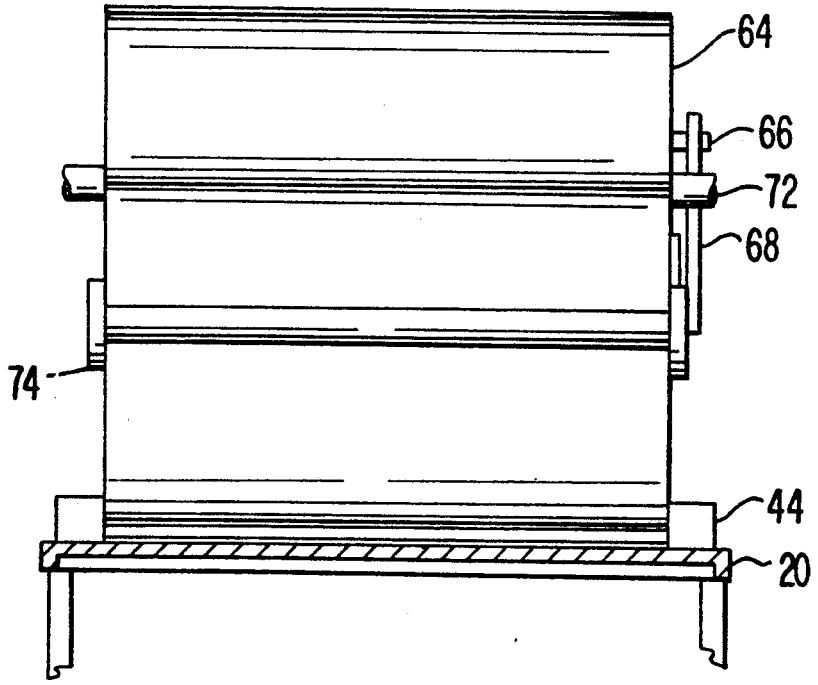
FIG. 6 is a transverse sectional view along line 6—6 of FIG. 4.

An apparatus which is particularly advantageous for applying the material to the plywood substrate is shown in FIGS. 4, 5 and 6. As shown therein, the apparatus includes a metal table 20 having a substantially flat top surface which is preferably about 5 feet wide and at least 6 feet long. At opposite ends of the table are a drive roller 22 and a return roller 24, both of which are rotatably mounted on a framework connected to the table. Each of these rollers is typically a 4 inch diameter steel roller. An endless conveyer belt 26 passes around these rollers, the upper portion of the belt extending along the top surface of table 20 and the return portion of the belt extending below the table. Roller 22 is provided with a pulley 28 which is coupled by a V belt 30 to a similar pulley 32 on a drive motor 34 which is supported on the table.

The conveyer belt, which is about 47.5 inches in width, is driven so that the portion extending along the top of the table moves in the direction of arrow 33, receiving and driving sheets of plywood 36, 37 in the direction of arrow 33 as well. A plurality of guide members such as rollers 40, 42 and 44 are spaced along the lateral edges of the table, the inner surfaces of the pairs of rollers being spaced apart approximately 4 feet to engage and guide the side edges of the sheets of plywood along the table.

As each sheet of plywood enters the machine at the left in FIG. 4, the conveyer belt 26 pulls the plywood under a first roller which is a press roller comprising a 3 inch diameter steel pipe the exterior of which is wrapped with a 1 inch thick layer of vinyl nitrite neoprene foam. Press roller 48 has a 1 inch shaft at each end, these shafts being journaled in a well-known fashion on pillow blocks fastened outside of the guides. The function of roller 48 is to press the plywood onto the conveyer belt so that it can be pulled through the subsequent portions of the machine, and also to flatten plywood sheets which may be warped before they pass under the subsequent glue roller. The pillow blocks which rotatably support the ends of roller 48 can be mounted on sliding square tubing to permit vertical motion of the roller as plywood passes under it to accommodate plywood sheets of different thicknesses.

A glue roller 50 follows the press roller at a distance of about 12 inches. The glue roller is a 4 inch steel tube covered with a ⅝ inch thickness of polyurethane foam. The pipe is provided with 1 inch shafts at opposite ends journaled in pillow blocks fastened outside the plywood guides. The function of this roller is to apply a uniform coating of adhesive to the upwardly facing major surface of the plywood as the plywood is pulled under it by the conveyer belt. This roller can also be mounted to be adjustable for different plywood thicknesses with a sliding square tubing arrangement that will permit vertical motion of the roller.

Located directly above glue roller 50 is a glue dispenser pipe 52 which can be a PVC pipe with an inner diameter of ½ inch, pipe 52 having the same length as the glue roller. The glue pipe 52 has 3/64 inch holes along the bottom of the pipe spaced at distances of roughly ⅝ inches. The glue pipe can be supported above glue roller 50 by a suitable support frame.

An adhesive tank 54, mounted at some convenient location near the table, contains a supply of a suitable glue which can be a water-soluble polyvinyl acetate adhesive. A pump 56 is connected to tank 54 and pumps glue to pipe 52 through a supply tube 58. Pump 56 fills pipe 52 with the glue which drips from the holes along the bottom onto the glue roller. The glue roller foam becomes saturated and, as the plywood rolls through the machine, the roller 50 applies the glue to the plywood surface.

The amount of adhesive which is applied to the plywood is controlled by the speed of pump 56 which is preferably a positive displacement pump. Pump 56 is controlled by a variable speed motor 60 the speed of which is controlled by a rheostat 62. A suitable motor for driving the pump is an AC/DC gear motor directly coupled to the pump. As the motor and pump increase speed, the supply of adhesive to the glue roller is increased.

A supply roll of foil material 64 is rotatably supported on a tubular roller 66 supported on a frame above table 20. The details of the support frame are not illustrated for simplicity. The roll is free-wheeling and the rotation thereof is controlled by an adjustable friction clutch which includes a pulley 67 attached to the end of pipe 66, a belt 68 which passes around pulley 67 and around a non-rotatable pulley 69 mounted on an adjustable arm 70. Arm 70 is pivotable about a pivot point 71 which is attached to a fixed location. Pulley 67 rotates with the supply roll of the foil and kraft paper material 64 and tends to carry belt 68 along with it. However, friction between belt 68, non-rotatable pulley 69 and pulley 67, to the extent that the pulley and belt speed are different, creates a drag which can be adjusted by the angular position of arm 70 to limit free-wheeling and uncontrolled dispensing of the material from the supply roll.

Material rom supply roll 64 passes over a support bar 72 and around an alignment roller 74 which is rotatably supported above the plywood material passing along table 20. Alignment roller 74 is a 3 inch tubular steel roller provided with spaced alignment collars spaced 48⅛ inch apart to align the material directly over the travel path of the plywood as it leaves the supply roller. After passing the alignment roller, the foil material web is next fed under a press roller 76 which presses the aluminum sheet onto the upper surface of the plywood to which glue has been applied. The press roller comprises a 1 inch steel shaft the ends of which are journaled in suitable pillow blocks. A fibrous roller pad of about 1 inch thickness surrounds the press roller to provide pressure against the foil material web without scuffing or wrinkling the aluminum sheet. Again, the press roller 76 can be mounted on sliding square tubing to permit vertical motion as the plywood passes under the roll.

Plywood is continuously fed through the machine, each piece abutting the piece preceding and following it. As the sheets of plywood leave the machine, the foil material extending from one sheet to the next is cut by a razor knife at the abutting ends. The laminated sheets are pushed by the conveyer onto a gravity roller indicated generally at 80 from which they can be removed and stacked.

Figure 7:
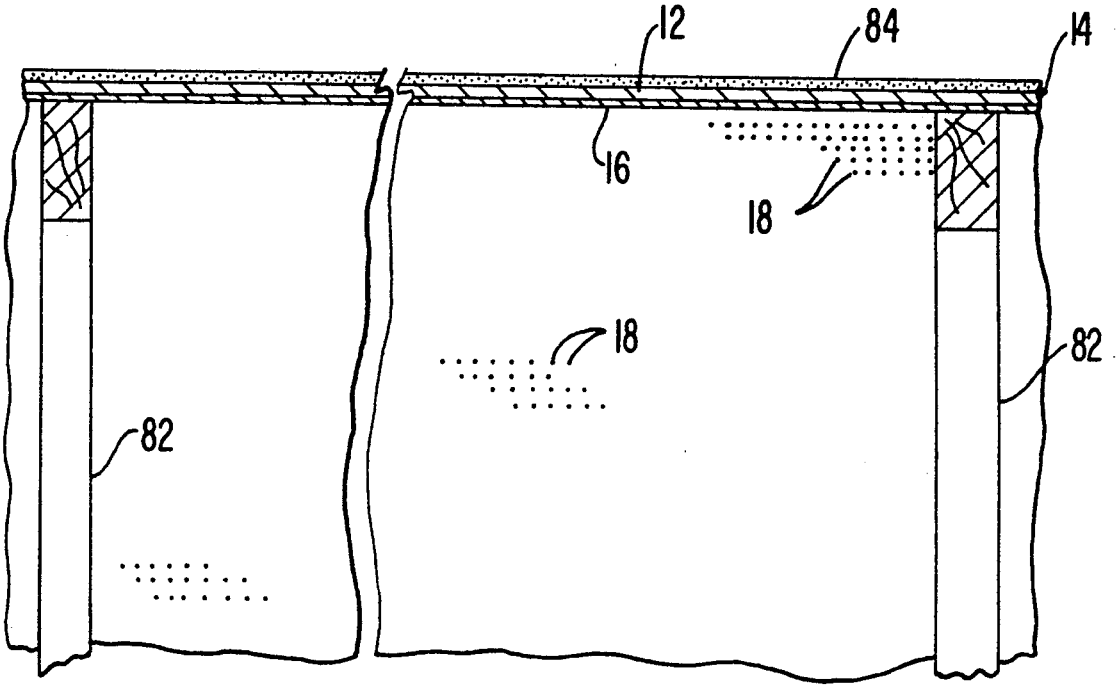
FIG. 7 is a partial sectional view of a typical roof structure incorporating the decking material of the present invention.
Figure 8:
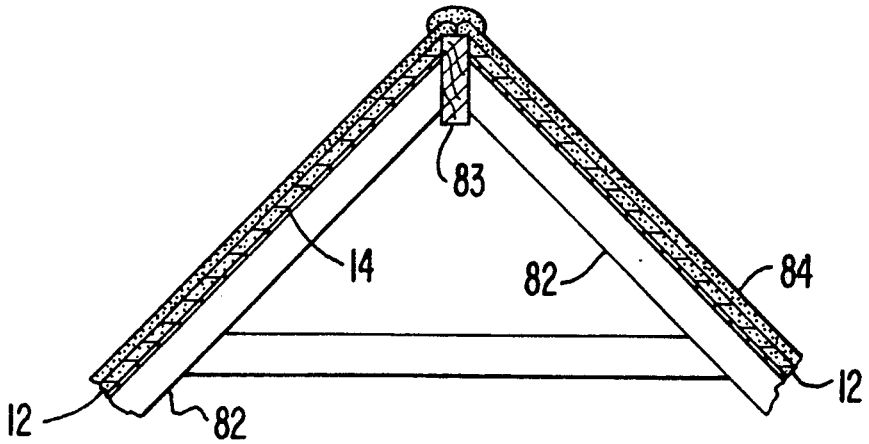
FIG. 8 is a transverse sectional view along line 8—8 of FIG. 7.

FIGS. 7 and 8 show sectional views through a portion of a typical roof employing the material of the present invention. A plurality of rafters 82 extend between a ridge beam 83 or the like, not shown, and a top plate or hammer beam, not shown, in a conventional manner to form a support, usually sloping, for other roofing material. Sheets of decking material are attached to those rafters. In accordance with the invention, plywood 12 or similar material having a layer of foil material 14 adhered thereto is attached to the rafters so that the foil 16 faces inwardly toward the atic or other space immediately below the roof structure. As described above, the foil 16 is provided with perforations 18 to allow "breathing" of the plywood, a few of the perforations being indicated in FIG. 7. Tar paper, shingles and other roofing material 84 is then attached to the outer surface of the plywood 12, as desired.

It is particularly important to recognize that the foil 16 attached to the plywood face inwardly and that its exposed surface, i.e., the downwardly facing surface opposite that attached to the plywood or intervening kraft paper, be uncovered and exposed to the air within the attic except, of course, in those small regions where it lies against the surfaces of the supporting rafters 82. In this fashion, the foil acts as a low-emission radiator, transferring minimal energy by radiation into the attic space and reducing the attic temperature drastically from that existing when the plywood is used without the foil.

While certain advantageous embodiments have been chosen to illustrate the invention, it will be understood by those skilled in the art that various changes and modifications can be made therein without departing from the scope of the invention as defined in the appended claims.

What is claimed is:

1. A roof structure comprising the combination of a roof framing structure including a plurality of rafters for supporting roofing material; and a roof decking material comprising a substantially flat sheet of substantially rigid wood roof sheathing panel material having an inner side and an outer side; and a sheet of foil material having one surface adhered to said inwardly facing surface of said sheet of sheathing panel material and the other surface of said sheet of foil material uncovered, said foil and sheathing panel material being fastened to said rafters with said foil toward said rafters so that said other surface of said foil facing downwardly between said rafters is exposed to air, said foil material including means being a plurality of substantially uniformly distributed perforations through said foil material to permit passage of moisture therethrough.

2. A structure according to claim 1 wherein said sheathing panel material is plywood.

* * * * *